US012378488B1

(12) United States Patent
Mykytiuk

(10) Patent No.: US 12,378,488 B1
(45) **Date of Patent: *Aug. 5, 2025**

(54) FUEL MIXTURE FOR INTERNAL COMBUSTION ENGINES WITH REDUCED CO2 EMISSIONS AND METHOD FOR MANUFACTURING THE SAME

(71) Applicant: Unique Equipment Solutions LLC, Ayer, MA (US)

(72) Inventor: Oleksandr Yuriiovych Mykytiuk, Kyiv (UA)

(73) Assignee: Unique Equipment Solutions LLC, Ayer, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/656,421

(22) Filed: May 6, 2024

Related U.S. Application Data

(63) Continuation of application No. 17/987,568, filed on Nov. 15, 2022, now Pat. No. 11,976,247.

(51) Int. Cl.
*C10L 1/12* (2006.01)

(52) U.S. Cl.
CPC ..... *C10L 1/1208* (2013.01); *C10L 2200/0218* (2013.01); *C10L 2200/024* (2013.01); *C10L 2200/0423* (2013.01); *C10L 2200/043* (2013.01); *C10L 2200/0446* (2013.01); *C10L 2290/38* (2013.01); *C10L 2290/547* (2013.01)

(58) Field of Classification Search
CPC ..... C10L 1/1208; C10L 2200/0218; C10L 2200/024; C10L 2200/0423; C10L 2200/043; C10L 2200/0446; C10L 2290/38; C10L 2290/547
See application file for complete search history.

(56) References Cited

U.S. PATENT DOCUMENTS

| | | | | |
|---|---|---|---|---|
| 9,822,320 | B1 | 11/2017 | Wright | |
| 9,885,001 | B2 * | 2/2018 | Niedermeyer | C10L 1/1208 |
| 10,793,795 | B1 | 10/2020 | Shenderova | |
| 11,015,128 | B1 | 5/2021 | Zoican-Loebick | |
| 2009/0000186 | A1 | 1/2009 | Sanders | |
| 2010/0212221 | A1 | 8/2010 | Aradi | |
| 2013/0337998 | A1 | 12/2013 | Irving | |
| 2016/0082513 | A1 | 3/2016 | Niedermeyer | |
| 2016/0083665 | A1 | 3/2016 | Niedermeyer | |
| 2022/0073831 | A1 | 3/2022 | Jun | |
| 2022/0145195 | A1 * | 5/2022 | Polunkin | C01B 32/15 |
| 2023/0373791 | A1 * | 11/2023 | Jasinski | C01B 32/15 |

* cited by examiner

*Primary Examiner* — Ellen M McAvoy
(74) *Attorney, Agent, or Firm* — Loginov & Associates, PLLC; William A. Loginov

(57) ABSTRACT

This invention provides a system and method/process for treatment of fuel used in internal combustion engines that advantageously reduces greenhouse gasses and pollutants given off during combustion and provides all the above effects without the need to include additional traditional additives that increase costs and may be environmentally harmful. Nanoparticles of one or more metals are added to a fuel mixture, where the mixture consists of hydrophobic or hydrophilic biofuels of plant or animal origin and/or sulfur containing petroleum distillates. An electro-chemical process/method can then be employed, by passing a current through the mixture, to produce metal nanoparticles. These metal nanoparticles have a wide range of benefits when added to the fuel solution, and allow the user to avoid the use of such traditional fuel additives.

19 Claims, 1 Drawing Sheet

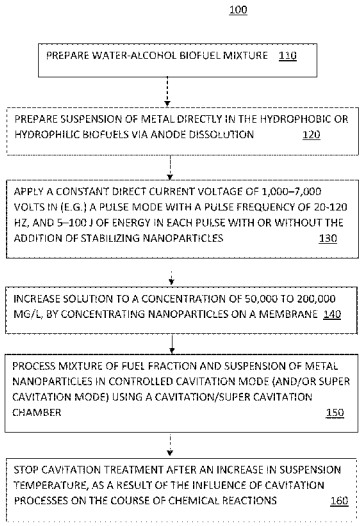

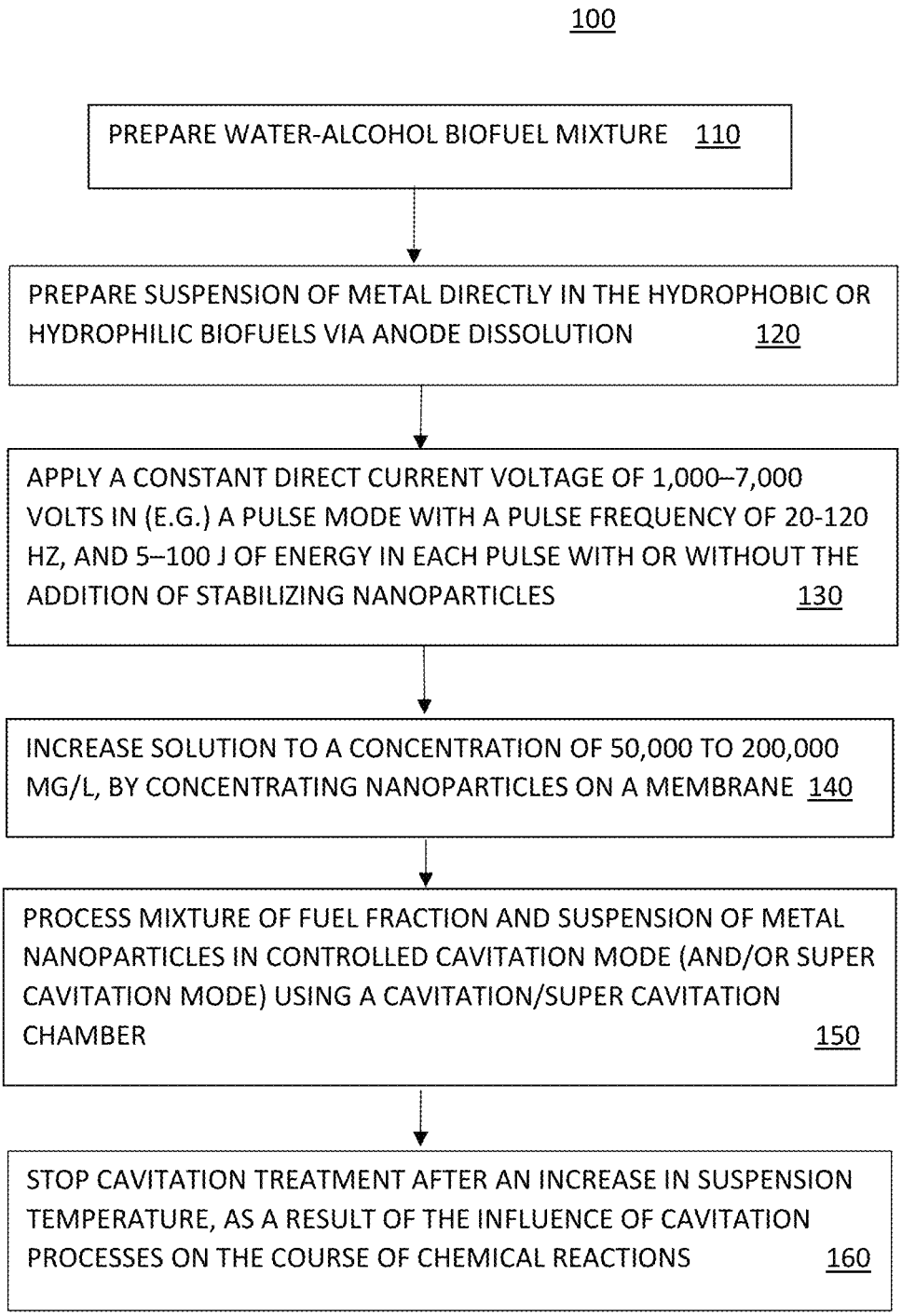
100
PREPARE WATER-ALCOHOL BIOFUEL MIXTURE 110
PREPARE SUSPENSION OF METAL DIRECTLY IN THE HYDROPHOBIC OR HYDROPHILIC BIOFUELS VIA ANODE DISSOLUTION 120
APPLY A CONSTANT DIRECT CURRENT VOLTAGE OF 1,000–7,000 VOLTS IN (E.G.) A PULSE MODE WITH A PULSE FREQUENCY OF 20-120 HZ, AND 5–100 J OF ENERGY IN EACH PULSE WITH OR WITHOUT THE ADDITION OF STABILIZING NANOPARTICLES 130
INCREASE SOLUTION TO A CONCENTRATION OF 50,000 TO 200,000 MG/L, BY CONCENTRATING NANOPARTICLES ON A MEMBRANE 140
PROCESS MIXTURE OF FUEL FRACTION AND SUSPENSION OF METAL NANOPARTICLES IN CONTROLLED CAVITATION MODE (AND/OR SUPER CAVITATION MODE) USING A CAVITATION/SUPER CAVITATION CHAMBER 150
STOP CAVITATION TREATMENT AFTER AN INCREASE IN SUSPENSION TEMPERATURE, AS A RESULT OF THE INFLUENCE OF CAVITATION PROCESSES ON THE COURSE OF CHEMICAL REACTIONS 160

FUEL MIXTURE FOR INTERNAL COMBUSTION ENGINES WITH REDUCED CO2 EMISSIONS AND METHOD FOR MANUFACTURING THE SAME

RELATED APPLICATION

This application is a continuation of co-pending U.S. patent application Ser. No. 17/987,568, entitled FUEL MIXTURE FOR INTERNAL COMBUSTION ENGINES WITH REDUCED CO2 EMISSIONS AND METHOD FOR MANUFACTURING THE SAME, filed Nov. 15, 2022, the teachings of which are expressly incorporated herein by reference.

FIELD OF THE INVENTION

This invention relates to production and use of fuel and lubricants, and more particularly the production and use of fuel additives for fuels employed to operate combustion engines, in a manner that reduces $CO_2$ emissions.

BACKGROUND OF THE INVENTION

It is believed that a significant source of greenhouse gas emissions, namely carbon dioxide ($CO_2$) and nitrogen oxides (NOX), occurs in the transportation sector, including road, rail, and sea transportation. In addition, to $CO_2$ and NOX emissions, burning sulfur-containing organic fuel in the internal combustion engines causes sulfur dioxide ($SO_2$) emissions which pollute the air.

Currently, the reduction of NOX emissions with exhaust gases of internal combustion engines is achieved by installing a suitable catalytic converter on the exhaust emissions pipe of the vehicle, which is expensive, and requires periodic replacement. To reduce $SO_2$ emissions produced from internal combustion engine exhaust gases, low-sulfur fuels, namely with a concentration of sulfur of up to 5 ppm are used. Traditionally, to perform a deep cleaning of the fractional sulfur from the fuel, up to 15%, of the fractional volume of the distillation fuel is lost and the economic cost is high, requiring expensive catalysts and the use of high temperatures and pressures. In addition, deep cleaning of fractional sulfur from the fuel causes air pollution due to catalysis of sulfur-containing organic compounds, and additional greenhouse gas emissions as a result of the process of reducing the fractional sulfur content by distillation to the desired level.

It is also known that the presence of metal ions in carbon-hydrogen fuels is undesirable, mainly because metal ions contribute to the oxidation of individual organic molecules that are part of the fuel, which decreases the overall efficiency of the combustion engine.

There are many characteristics of traditional fuel, during storage, and combustion, which can be improved by the addition of chemical compounds. The following is a non-exhaustive list of some of the additives used and the traits achieved by those compounds:

- Antioxidant stabilizers, which increase the oxidative stability of fuels, preventing resin and sedimentation;
- metal deactivators, which bind copper, iron and other metals into inactive complexes, and are also promoters of oxidation of hydrocarbons;
- washing additive, which reduces the formation of deposits on the parts of engines and fuel equipment, including engines with direct injection of gasoline, and also provide anti-glacial and anticorrosive properties to fuels;
- anti-smoke additives, which reduce the concentration of smoke in the gases of diesel engines, but have little effect on the emissions of other toxic components;
- anti-stick additives, which reduce heat formation in the combustion chamber, on valves and sprayers of diesel engine nozzles;
- anti-soot additives, which reduce the combustion temperature of soot on the surface of filters;
- anti-detonators, which prevent detonation burning of gasoline;
- ignition promoters, which improve the ignition of diesel fuels;
- antistatic additives, which prevent the accumulation of static electricity charges in the field;
- biocides, which prevent fuel damage by microorganisms;
- dispersing additives to fuel oils, which increase the physical stability of residual fuels, and improve their mixture formation with air, as well as having protective properties; and
- catalysts for burning fuel oils, which increase the combustion efficiency of residual fuels.

SUMMARY OF THE INVENTION

This invention overcomes disadvantages of the prior art by providing a system and method/process for treatment of fuel used in internal combustion engines that advantageously reduces greenhouse gasses and pollutants given off during combustion and provides all the above effects without the need to include additional traditional additives that increase costs and may be environmentally harmful. In addition to the above effects, the mixture increases fuel savings by at least 8-12%, compared to the corresponding traditional fuel with additives, while maintaining the power of the internal combustion engine, and while using traditional fuel.

Nanoparticles of one or more metals are added to a fuel mixture, where the mixture consists of hydrophobic or hydrophilic biofuels of plant or animal origin, and/or sulfur containing petroleum distillates. An electro-chemical process/method is then employed, passing a current through the mixture, to produce metal nanoparticles. These metal nanoparticles have a wide range of benefits when added to the fuel solution, and allow the user to avoid the use of a variety of more costly and environmentally harmful traditional fuel additives. Those benefits are listed below.

According to one aspect of the illustrative process employing metal nanoparticles is that such metal nanoparticles can be generated in the environment of hydrophobic or hydrophilic biofuels under the influence of cold plasma energy, having a positive, neutral or negative charge on their respective surfaces, depending upon the acidity of the solution, and a such nanoparticles exhibit a large surface area due to their nanoscale structure. Because of their large surface area and positive or negative charge, the atoms/molecules of the nanoparticles are able to become active sites for complex compounds, and agglomerates with fuel and water molecules. Because of these properties complex metal-organic compounds are formed during the cavitation (and/or super cavitation) processing of the mixture due to the energy of cavitation processes.

The illustrative method/process herein also reduces $SO_2$ emissions by up to 70% within exhaust gases when burning the fuel mixture in the internal combustion chamber, as well as reducing NOX emissions by up to 50%. The absence of carbon particles, soot in exhaust gases, and lack, over time, of soot deposits on the internal parts of the engine as a result of addition to the fuel mixture of nanoparticles of one or more metals helps achieve all of the aforementioned advantageous results, as well as enabling the user to avoid a deep cleaning of the fractional fuel mixture to remove sulfur.

The described method/process for fuel treatment additionally increases the cetane number of the fuel mixture by 1-2 units (or more), compared to the cetane number of the distillation fuel fraction and biofuels, which are the basis of the illustrative fuel mixture. This increase allows the fuel to ignite in the combustion chamber more easily, increasing the performance of the engine. The added nano-metal particles have also been found to decrease engine vibration as a result of the combustion of the illustrative fuel mixture in the internal combustion engine chamber as well as lowering the clouding temperature of the illustrative mixture, which lowers the temperature at which paraffin wax separates from the fuel, and furthermore improves engine efficiency at low temperatures. Additionally, the metal nanoparticles provide anti-detonation properties, decreasing premature detonation in the internal combustion engine. The fuel mixture is also not polymerized during long-term preservation, and does not lose high derivative efficiency when burned in internal combustion engines.

Finally, the treated fuel mixture according to the illustrative process herein allows for a relative reduction in the combusted volume versus output power due to an increase in the efficiency (completeness) of combustion of the fuel in the engine chamber—and as such, fuel efficiency is increased by up to approximately 12% (or more).

In an illustrative embodiment, a fuel mixture based on carbon-hydrogen fuel is produced by a process that includes forming a suspension of metal nanoparticles in the fuel, increasing a concentration of the metal nanoparticles in the fuel by flow-through filtration thereof, and performing controlled cavitation of the fuel until the fuel attains a predetermined temperature. Illustratively, the resulting fuel mixture can comprise 80%-98% of petroleum distillate, 1%-19% hydrophobic or hydrophilic biofuel, 0.1%-1.0% metal nanoparticles, 0.1%-2% water, and 0.01%-0.05% nanoparticle stabilizing compound. More particularly, the petroleum distillate can comprise at least one of diesel, kerosene and gasoline and/or the metal nanoparticles can comprise at least one of iron and aluminum. The nanoparticles can be generated in the biofuel using an electro-chemical process that can be characterized by use of a constant current voltage of 1,000-7,000 volts in pulse mode with a pulse frequency of 20-100 Hz, and energy in pulse of 5-100 J. The filtration process can occur over a time interval of 15-45 minutes, with flow rate of fuel mixture therethrough 1-2 m/s, so as to generate a concentration of metal nanoparticles in a suspension of 10,000-15,000 mg/l. The fuel can be a hydrophilic biofuel in which a suspension of the nanoparticles in the fuel is generated in a water-fuel solution using an electrochemical process in which, the nanoparticles are stabilized, with a DC voltage of 8-20 volts, the preparation time of suspension is 15-45 minutes at a flow rate is 1-2 m/s, and the filtration generates a concentration of metal nanoparticles 10,000-15,000 mg/l in the suspension. Alternatively, the fuel can be a hydrophilic biofuel and the metal nanoparticles are generated directly in a water-fuel solution by dissolution of an anode metal and subsequent formation of nanoparticles from metal ions of the anode in a renewable manner that is free of addition of reagents with restorative properties. The filtration process can generate a concentration of the metal nanoparticles of 50,000-200,000 mg/l by separating nanoparticles from part of a water-fuel solution or biofuel on a first membrane. The first membrane can define a pore size of approximately 200 nm, so as to separate out the nanoparticles having a size larger than approximately 200 nm. The filtration process can further comprise concentrating filtrate from the first membrane onto a second membrane with a pore size of approximately 40 nm, and adding to the filtrate a nanoparticle stabilizing compound. Illustratively, the nanoparticle stabilizing compound can be an organic known to those of skill in the art. A method of manufacture of the above-described fuel mixture can be performed in an illustrative embodiment.

BRIEF DESCRIPTION OF THE DRAWINGS

The invention description below refers to the accompanying drawings, of which:

FIG. 1 is a flow diagram of a fuel treatment process using nanoparticles according to an illustrative embodiment.

DETAILED DESCRIPTION

I. Overview

A system and method (or process) for reducing the greenhouse gas emissions and increasing fuel efficiency are described herein, where the effects are achieved without the use of appropriate additives. More particularly, and by way of non-limiting example, the illustrative system or method/process of manufacturing a fuel mixture herein can be advantageously applied to sulfur-containing petroleum distillate fuels, as well as low/no-sulfur biofuels.

II. Formula of Substance

The formula of the fuel mixture consists of:

80%-98% distillation carbon-hydrogen fuel fractions (petroleum distillates), for example, diesel, kerosene and/or gasoline fractions, or related fuels (and/or mixtures thereof); 2%-20% hydrophobic or hydrophilic biofuels derived from vegetable and/or animal sources with metal nanoparticles suspended therein; 01%-1.0% nanoparticles of metals, namely iron, aluminum; 0.1%-2% water; and 0.1%-0.05% of one of the known stabilizing nanoparticle additives.

III. Method of Preparation

In order to prepare the solution above, the following method/process of preparation is employed, with further reference to the process 100 of FIG. 1:

In step 110, a water-fuel solution is created, where water is added to 30-50% concentrated ethanol or isopropic alcohol, or any other alcohol, or other known water-soluble biofuels. Then, in step 120, a suspension of metal nanoparticles is then prepared directly in the hydrophobic or hydrophilic biofuel via an anode dissolution process, where cold plasma cells are generated. Waste metal between 3-8 mm is used to form an anode in any shape. In step 130 an electro-chemical method is used, with a constant direct current voltage of 1,000-7,000 volts. As such, a pulse mode, with (e.g.) a pulse frequency of 20-120 Hz, and 5-100 J of energy in each pulse can be used with or without the addition of stabilizing nanoparticles. The preparation time of suspension of the required concentration is between 15-45 minutes in a flow-through processing chamber with a flow stream rate of approximately 1-2 m/s.

The maximum size of nanoparticles in suspension can be controlled by the running the solution through a synthetic membrane with a pore size of 200 nm. By way of non-limiting example, the derivative suspension of metal nanoparticles should then be of a concentration between 10,000-15,000 mg/l, In step 140, the solution is then increased to a concentration of 50,000 to 200,000 mg/L, by concentrating nanoparticles on a membrane through which the solution passes with a pore size of approximately 40 nm. The suspension of nanoparticles in the biofuel or in the water-fuel solution is added in the appropriate proportion, with metal nanoparticles of the appropriate size, in which the nanoparticles carry either a positive or negative charge, and define generally, chemically active centers for the formation of complex compounds and/or agglomerates with fuel and water molecules due to their relatively large surface area.

In step 150, the mixture of fuel fraction and suspension of metal nanoparticles is then processed in a controlled cavitation mode (and/or super cavitation mode) using a cavitation/super cavitation chamber according to skill in the art, so as to initiate chemical reactions with the formation of metal-organic compounds saturated with oxygen, and for the transformation of a multicomponent mixture into a single-component mixture by forming complex compounds of the corresponding reagents and their agglomerates.

In step 160, the process of cavitation treatment of the mixture stops after an increase in suspension temperature, as a result of the influence of cavitation processes on the course of underlaying chemical reactions herein, for example, by 15-45° C.

IV. Illustrative Examples of Process

A. Example 1

From 40 liters of hydrophobic biofuels, namely biodiesel, a suspension of iron nanoparticles is prepared, by the electro-chemical process as described generally above, at a voltage of a constant current at 4,000 volts, a pulse frequency of 100 Hz, and a recycling feed rate of biodiesel of 2 m/s for 15 minutes. 40 liters of suspension of iron nanoparticles in biodiesel is fed to a ceramic membrane with a pore size of 200 nm at an atmospheric pressure of 2 atm, in a cross-filter mode, with a nanoparticle concentration of 15,000 mg/l. 38 liters of biodiesel suspension with iron nanoparticles up to 200 nm are mixed mechanically with 562 liters of diesel fuel. 600 liters of the mixture of suspension of nanoparticles and diesel fuel are homogenized by cavitation treatment until the initial temperature of the mixture rises by 15° C. Then, the fuel mixture, with a nanoparticle content of 0.1% and a hydrophobic biofuel content of 6.3%, is ready for immediate or delayed use in an internal combustion—with (e.g.) no additional treatment and/or additives required.

B. Example 2

From 40 liters of hydrophobic biofuels, namely biodiesel, a suspension of iron nanoparticles is prepared by the electro-chemical process described above at a voltage of a constant current of 4,000 volts, with a pulse frequency of 100 Hz, a recycling feed rate of biodiesel of 2 m/s for 15 minutes. 40 liters of a suspension of iron nanoparticles in biodiesel is fed to a ceramic membrane with a pore size of 200 nm at an atmospheric pressure of 2 atm, in cross-filter mode, with a nanoparticle concentration of 15,000 mg/l. 38 liters of biodiesel suspension with iron nanoparticles up to 200 nm and a concentration of 15,000 mg/l nanoparticles is then fed through a ceramic membrane with a pore size of 40 nm at a pressure of 2 atm, in cross-filter mode. 3 liters of biodiesel suspension concentrate with iron nanoparticles up to 200 nm large and a concentration of nanoparticles of 50,000-20,000 mg/l are thereby obtained. Up to 3 liters of biodiesel suspension concentrate with iron nanoparticles of up to 200 nm large and a concentration of 142-500 mg/l nanoparticles added 19 liters of diesel fuel. 21 liters of the resulting mixture are homogenized by cavitation treatment until the initial temperature of the mixture rises by 15° C. This method describes a fuel mixture with a nanoparticle content of 1.0% and a hydrophobic biofuel content of 14.3% ready for immediate or delayed use.

37 liters of suspension of nanoparticles in hydrophobic biofuels is used to prepare the next portion of the mixture by the illustrative process(es) herein.

C. Example 3

Starting with 20 liters of hydrophilic biofuels, namely ethanol, 20 liters of fresh water is added, in addition to 0.3 liters of one of the known stabilizers of nanoparticles. From 40 liters of aqueous solution of hydrophilic biofuels, a suspension of iron nanoparticles is prepared by the electro-chemical method described above using an anode made of iron, at a voltage, based on a constant current, of 20 volts. The rate of supply of aqueous solution of biofuels is maintained in a recycling manner at approximately 2 m/s for 15 minutes. 40 liters of suspension of iron nanoparticles in an aqueous solution of biofuels is fed to a ceramic membrane with a pore size of 200 nm at a pressure of 2 atm, in cross-filtering mode with a nanoparticle concentration of 15,000 mg/l. 38 liters of the suspension of aqueous solution of biofuels with iron nanoparticles up to 200 nm are then mixed mechanically with 562 liters of diesel fuel. 600 liters of the mixture of suspended nanoparticles and diesel fuel are then homogenized by cavitation treatment until the initial temperature of the mixture rises by 15° C. The exemplary process provides a fuel mixture with a nanoparticle content of 0.1% and a hydrophilic biofuel content of 6.3% which is ready for immediate or delayed use.

D. Example 4

In this example of an iterative process, 20 liters of fresh water and 0.3 liters of one or more known stabilizer(s) of nanoparticles is added to 20 liters of hydrophilic biofuels, namely ethanol. In the resulting 40 liters of aqueous solution, iron nanoparticles are prepared by the electrochemical process using an anode made of iron, at a voltage, at a constant current, of 20 volts, with a supply rate of the aqueous solution biofuels of 2 m/s for 15 minutes. 40 liters of the suspension of iron nanoparticles in an aqueous solution of biofuels is then fed to a ceramic membrane with a pore size of 200 nm at a pressure of 2 atm, in a cross-filtering mode with a nanoparticle concentration of 15,000 mg/l. 38 liters of the suspension of the aqueous solution of biofuel, with iron nanoparticles up to 200 nm, is then fed to a ceramic membrane with a pore size of 40 nm at a pressure of 2 atmospheres in cross-filter mode. 3 liters of the resulting suspension concentrate of the aqueous solution of hydrophilic fuel with iron nanoparticles (between 40 and 200 nm) up to 200 nm and a concentration of nanoparticles of 190-500 mg/l is obtained. Up to 3 liters of this biodiesel suspension concentrate with iron nanoparticles up to 200 nm and a concentration of 142-500 mg/l nanoparticles is then added 19 liters of diesel fuel. 21 liters of the resulting mixture is homogenized by cavitation treatment until the initial temperature of the mixture rises by 15° C. The resulting fuel mixture, with a 1.0% nanoparticle content and a hydrophilic fuel content of 7.2%, is ready for immediate or delayed use with (e.g.) no further treatment required.

V. Conclusion

It should be clear that the above-described system and method/process for producing a fuel mixture with reduced harmful emissions is relatively straightforward and employs additives that are economical to produce with low environmental impact. The treated fuel also increases combustion efficiency, and reduces wear and fouling of internal combustion engine components.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances of the system (e.g. 1-5 percent). Accordingly, this description is meant to be taken only by way of example, and not to otherwise limit the scope of this invention.

What is claimed is:

1. A method for manufacturing a fuel mixture based on carbon-hydrogen fuel, comprising the steps of:

forming a suspension of metal nanoparticles in the fuel;

filtering the fuel containing the suspension to, thereby, increase a concentration of the metal nanoparticles in the fuel; and causing a cavitation of the fuel until the fuel attains a predetermined temperature.

2. The method as set forth in claim 1, further comprising, providing to fuel mixture so as to include 80%-98% of petroleum distillate, 1%-19% hydrophobic or hydrophilic biofuel, 0.1%-1.0% metal nanoparticles, 0.1%-2% water, and 0.01%-0.05% nanoparticle stabilizing compound.

3. The method as set forth in claim 2, wherein the step of providing includes providing the petroleum distillate as at least one of diesel, kerosene and gasoline.

4. The method as set forth in claim 2, wherein the step of providing includes formulating the metal nanoparticles as at least one of iron and aluminum.

5. The method as set forth in claim 2, further comprising, generating the nanoparticles in the biofuel using an electrochemical process with a constant current voltage of at least one of (a) 1,000-7,000 volts in pulse mode, (b) a pulse frequency for the constant voltage of 20-100 Hz, and (c) an energy pulse for the constant voltage 5-100 J.

6. The method as set forth in claim 1, wherein the step of filtering is a flow-through process that occurs over a time interval of 15-45 minutes with flow rate of 1-2 m/s, so as to generate a concentration of metal nanoparticles in a suspension of 10,000-15,000 mg/l.

7. The method as set forth in claim 1, wherein the fuel is a hydrophilic biofuel in which a suspension of the nanoparticles in the fuel is generated in a water-fuel solution using an electrochemical comprising the steps of, stabilizing the nanoparticles with a DC voltage of 8-20 volts, and preparing the suspension for 15-45 minutes at a flow rate is 1-2 m/s, and wherein the step of filtering generates a concentration of metal nanoparticles 10,000-15,000 mg/l in the suspension.

8. The method as set forth in claim 1, wherein the fuel is a hydrophilic biofuel, and generating the metal nanoparticles directly in a water-fuel solution by dissolution of an anode metal and subsequently forming nanoparticles from metal ions of the anode in a renewable manner that is free of addition of reagents with restorative properties.

9. The method as set forth in claim 1, wherein the step of filtering generates a concentration of the metal nanoparticles of 50,000-200,000 mg/l by separating nanoparticles from part of a water-fuel solution or biofuel on a first membrane.

10. The method as set forth in claim 9, wherein the first membrane defines a pore size of approximately 200 nm, so as to separate out the nanoparticles having a size larger than approximately 200 nm.

11. The method as set forth in claim 10, wherein the step of filtering further comprises, concentrating filtrate from the first membrane onto a second membrane with a pore size of approximately 40 nm and adding to the filtrate a nanoparticle stabilizing compound.

12. The method as set forth in claim 11, wherein the nanoparticle stabilizing compound is organic.

13. The method as set forth in claim 1, further comprising, providing to fuel mixture so as to include petroleum distillate, hydrophobic or hydrophilic biofuel, metal nanoparticles, water, and a nanoparticle stabilizing compound.

14. A fuel mixture manufactured by the method of claim 13.

15. The fuel mixture as set forth in claim 14, wherein the petroleum distillate is as at least one of diesel, kerosene and gasoline.

16. The fuel mixture as set forth in claim 15, wherein the metal nanoparticles are at least one of iron and aluminum.

17. A fuel mixture manufactured by the method of claim 1.

18. A fuel mixture manufactured by the method of claim 5.

19. A fuel mixture manufactured by the method of claim 7.

* * * * *